United States Patent [19]

Höppner et al.

[11] Patent Number: 4,471,923

[45] Date of Patent: Sep. 18, 1984

[54] UNMANNED AIRCRAFT

[75] Inventors: Heinz-Jochen Höppner, Bremen; Hugo Sgarz, Bremen-Lesum; Herbert Sadowski, Delmenhorst, all of Fed. Rep. of Germany

[73] Assignee: Vereinigte Flugtechnische Werke MBB, Bremen, Fed. Rep. of Germany

[21] Appl. No.: 410,700

[22] Filed: Aug. 23, 1982

[30] Foreign Application Priority Data

Aug. 22, 1981 [DE] Fed. Rep. of Germany ..... 3133339

[51] Int. Cl.[3] ..... B64C 3/56; F41F 3/00

[52] U.S. Cl. ..... 244/63; 244/49; 244/3.27; 244/58; 89/1.816; 89/1.818

[58] Field of Search ..... 244/2, 49, 45 R, 120, 244/124, 73–74, 63, 65, 67, 69, 58, 3.1, 3.22–3.28, 14; 102/374–381; 89/1.8–1.819

[56] References Cited

U.S. PATENT DOCUMENTS

| | | | |
|---|---|---|---|
| 2,390,677 | 12/1945 | Alkan et al. | 244/14 |
| 2,961,928 | 11/1960 | Rosenthal | 89/1.816 |
| 2,977,080 | 3/1961 | VonZborowski | 244/2 |
| 2,992,794 | 7/1961 | Boyd | 244/120 |
| 2,998,754 | 9/1961 | Bialy | 89/1.816 |
| 3,138,352 | 6/1964 | Saholt | 89/1.819 |
| 3,460,430 | 8/1969 | Fisher | 89/1.818 |
| 4,198,896 | 4/1980 | Lamic et al. | 89/1.818 |
| 4,296,894 | 10/1981 | Schnabele et al. | 244/3.1 |
| 4,410,151 | 10/1983 | Hoppner et al. | 244/120 |

FOREIGN PATENT DOCUMENTS

| | | | |
|---|---|---|---|
| 959971 | 3/1957 | Fed. Rep. of Germany | 244/63 |

*Primary Examiner*—Galen Barefoot

*Attorney, Agent, or Firm*—Ralf H. Siegemund

[57] ABSTRACT

An unmanned aircraft vehicle to be launched from a container is provided with a rocket engine for launching and a propeller drive for cruising; the wings can be folded to the body of the vehicle and will be deployed as the vehicle leaves the launching container. The propeller is freely rotatable, even if the vehicle is still in the launching container. The rocket engine is releasably connected to at least one point on the propeller drive and in symmetrical relation to maintain the propeller drive coaxial to the propeller shaft, and to react rocket thrust directly into the propeller drive.

12 Claims, 8 Drawing Figures

UNMANNED AIRCRAFT

BACKGROUND OF THE INVENTION

The present invention relates to unmanned aircraft with a supplemental rocket type propulsion unit for takeoff and being particularly designed for launching from a launch silo or any other suitable tubular container.

In U.S. Pat. No. 4,410,151 by us and another such a vehicle is disclosed which is provided with a fuselage and folded down but deployable wings in order to fit into such a container but permitting deployment of the wings after the vehicle has left the container. In addition, a propeller is provided being preferably covered by a shroud and having dimensions to permit free rotation within the container. Moreover, the rocket propulsion and engine unit is releasably connected to the vehicle, to the rear of the propeller, for purposes of imparting a launching-assist thrust upon the vehicle permitting it to leave the silo or container, with the propeller already running.

Vehicles and unmanned aircraft of the type referred to above are also called mini-drones and they are used for example, for attacking air defense equipment of an enemy such as radar devices or the like. These vehicles, after launching, operate at first and for a certain period of time in a search or holding flight prior to attacking the target. During cruising, as well as during target searching, the propeller is the exclusive propulsion device, but as stated, launching is carried out by means of or under assistance of a rocket engine. A separate support structure is provided on the body of the vehicle by means of which the rocket drive is connected to that body or fuselage not only for purposes of physical interconnection but also for purposes of imparting thrust upon the vehicle proper. This connection is provided so that upon shutdown of the launching rocket the rocket engine automatically drops off the vehicle, together with the holding and connecting structure, and further propulsion is carried out thereafter exclusively by the propeller drive.

DESCRIPTION OF THE INVENTION

It is an object of the present invention to provide a new and improved airborne vehicle with rocket engine for a launch-assist such that the thrust is imparted centrally-axially upon the vehicle but pemitting subsequent release and dropoff of the rocket engine. The requirement of a central transfer of thrust should not function as a restriction concerning the construction of the vehicle as a whole, and the holding and mounting structure for the rocket engine should be simple and of light weight.

In accordance with the preferred embodiment of the present invention, it is suggested to provide a new and improved unmanned vehicle with propeller drive and launch assist rocket engine which is to be releasably mounted to the vehicle so as to separate with ease after the launching, the improvement being comprised of a mount for the rocket engine, centrally and coaxially to the propeller, and bearing at least against one point of the propeller drive.

The improvement is thus comprised of a particular construction for releasably affixing the rocket engine to the vehicle through a mounting and holding structure constituting a part of the rocket and being of a symmetrical configuration and engaging the propeller drive such that the rocket engine is disposed coaxially to the propeller shaft, and the resultant of the thrust transfer from the holding and mounting structure to the propeller drive produces a thrust in the longitudinal axis of the vehicle which is also the propeller axis.

In furtherance of the invention, the mounting and holding structure may include a coaxial extension of the rocket engine, bearing directly upon the propeller shaft for a central or centrally effective transmission of thrust forces while being journaled on the propeller shaft in order to remain stationary. Additionally or alternatively, the rocket engine may be provided with radial extensions and axially extending arms for engaging components on fins or the fins themselves, which extend radially from the fuselage or body of the vehicle near the after-portion thereof.

The thrust transfer and connection between the rocket engine and the propeller drive may also involve a shroud within which the propeller rotates and which is mounted directly on the propeller engine and is a part thereof. By means of radial blades or fins and particularly constructed elements at the end of these blades releaseable coupling and force transfer to the shroud may be provided for. In either case, symmetry has to be observed so that the resultant force vector coinsides with the propeller and longitudinal axis of the vehicle. The coupling structure involves convexly shaped ends on appropriate parts of the rocket engine being received by concavely shaped cups on the vehicle fins and/or the shroud. The rocket engine is perferably slidably held on the propeller shaft and at least one spring should be provided to effect separation when the radial thrust has dropped below the propeller thrust.

It should be noted that the above-identified application by us and another discloses in the FIG. 1 thereof a wing portion as being rigidly connected to the fuselage or body of the vehicle and only a portion of the wing is folded and deployable. This fixed portion of the wing is, in that particular instant, available for centering the rocket engine. This kind of capability, however, does not always exist and it is the present inventive concept which makes sure that the force transfer from the rocket engine to the vehicle as a whole and the releasable connection does not pose any material constraint upon the construction of the vehicle as a whole.

BRIEF DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

DETAILED DESCRIPTION OF DRAWINGS

Figure 1:
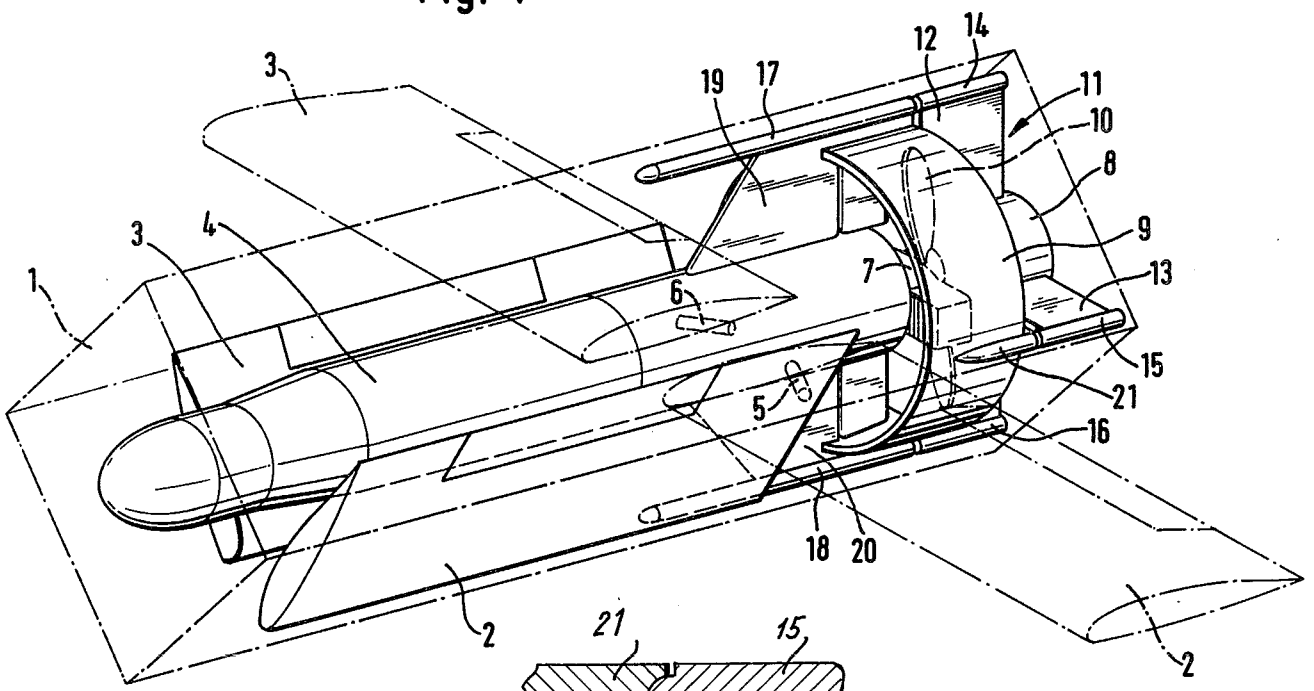
FIG. 1 is an isometric view of an unmanned vehicle constructed in accordance with the preferred embodiment of the present invention for practicing the best mode thereof and showing particularly the wings in an undeployed disposition, a launch container being indicated in phantom line.

Proceeding now to the detailed description of the drawings. FIG. 1 illustrates a transport storage and launch container or silo 1 being indicated here in dash-dot phantom lines because it does not pertain to the vehicle proper, but the vehicle is constructed to fit into that container prior to launching and the vehicle is launched from that container. The vehicle itself includes a fuselage or body 4 to which are pivotally linked airfoils or wings 2 and 3. The wings are shown twice, in solid line they depict their position inside the container 1 and the phantom line illustrate the wings in the deployed or folded open disposition attained as soon as the vehicle has left the launching container. Folding and pivoting of the wings is carried out by means of pins 5 and 6 which are arranged on the fuselage at an angle pointing laterally outwardly and in forward direction. This way the air foils and wings are folded in a forward position and extend from a rear point of linkage in forward direction; i.e., in the direction of flight and launching. This means that the wings are automatically deployed to attain an outward and lateral extension as wings, by means of air and inertia forces acting upon these wings as soon as the vehicle has left the container.

The vehicle basically can be propelled by means of two propulsion units, these units are both provided in the rear portion of the vehicle. There is first a propeller drive 7 for cruising, target searching and target approach. In addition, the vehicle is provided with a launch assist rocket engine 8 mounted to the vehicle in the manner to be described shortly. The propeller drive 7 is configured as a shrouded unit having a shroud 9 and the propeller 10 rotates inside of the shroud. Shroud 9 in turn, is dimensioned to fit in the container 1. Therefore, the propeller 10 can already be started while the vehicle is still inside the container. The shroud, of course, does not impede rotation of the propeller.

The rocket engine 8 is connected to the vehicle by means of a releasable holding structure 11. The structure 11 is constructed in such a manner that generally thrust produced by the rocket engine 8 can be imparted upon the vehicle in that the rocket bears against the vehicle itself. The position of the support point and the inventive configuration of the holding structure provides for a centering of the launching rocket engine 8 such that the thrust vector of the rocket drive runs directly in direction and inside the longitudinal axis of the vehicle and of fuselage and body 4. The holding and mounting device 11 includes particularly fin or blade structures 12 and 13 intersecting at right angles, the line of intersection (hypothetical) coinciding with the longitudinal axis of the rocket engine 8. The outer ends of the fins or blades 12 and 13 are provided respectively with tubular extensions or reinforcements 14, 15, 16 etc . . . each having at its respective front end a convexly shaped semi-spherical end and bearing surface.

Figure 1A:
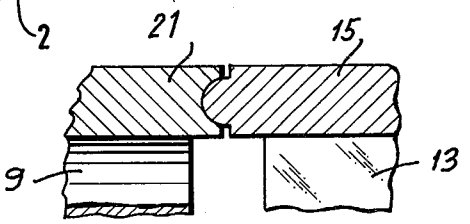
FIG. 1*a* illustrates a cross section through a detail in FIG. 1.
Figure 2:
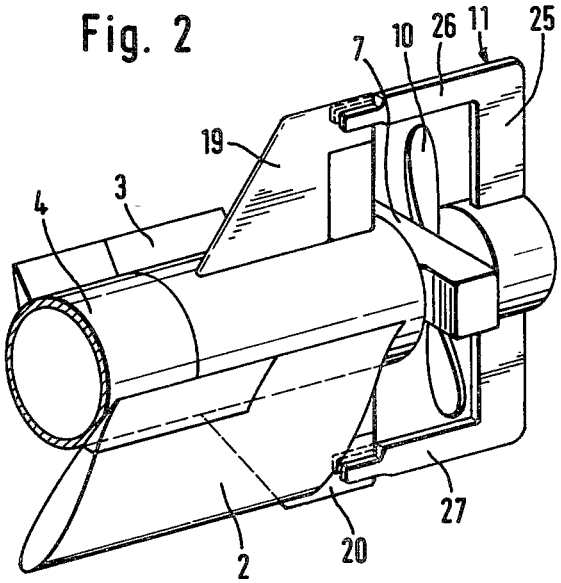
FIG. 2 is an isometric view of a modified example of the preferred embodiment of the present invention showing the vehicle only partially.
Figure 3:
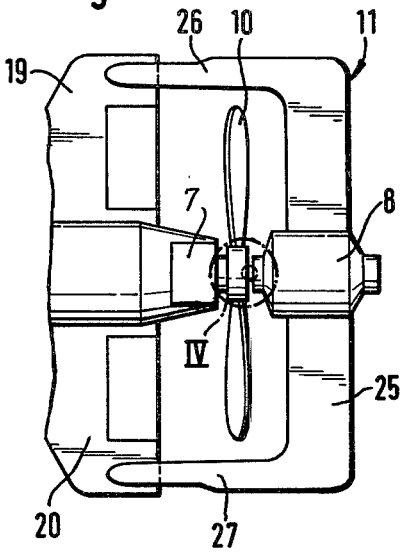
FIG. 3 is a side view of a portion of the construction shown in FIG. 2.

The extensions 14 and 16 constitute thrust transfer elements and cooperate for this purpose with two likewise tubular guide elements 17 and 18 whose respective rear portions are concavely configured for receiving the convexly shaped semi-spherical fronts of the extensions 14 and 16 respectively. These guide bodies or tubes 17 and 18 are arranged on the outer tips of slab-lining fins 19 and 20 extending radially from the fuselage 4. The guide elements, bodies or tubes 17 and 18, run in rails (not illustrated) of the container, such rails being arranged particularly along corners of these containers. Fins 19 and 20 extend in parallel to each other, and the blades 13 are arranged at right angles to the blades 12 and are similarly configured and carry particular thrust transfer elements 15, one being visible in FIG. 1 and there being another one arranged analogously and to the rear of the vehicle. These elements 15 have likewise convex, semi-spherical ends, which are received in tubular elements such as 21 on the shroud and having concave ends to the rear (see FIG. 1*a*). There is, of course, another one of these elements 21 to the rear of the drawing. The thrust receiving elements 21 have a pointed front tip for aerodynamic reasons.

The vehicle is launched from the inside of the container 1 in that the propeller drive 7 is started, the propeller 10 runs inside the shroud. Thereupon, the rocket engine 8 is fired and by means of the fins or blades 12 and 13, and elements 14, 15 and 16 thrust is imparted upon the receiving elements 17, 21 and 18. Therefore, the thrust is imparted upon the stabilizing fins and upon the shroud which is part of the propeller engine. Due to the central mounting of the shroud in relation to the body 4, and due to overall symmetry the thrust vector is effective directly in the center of the shroud, and therefore, along the longitudinal axis of the body 4. Additional thrust is imparted by the fins or blades 12 and the elements 14 and 16 cooperate with the extensions 17 and 18 which in turn supplements the thrust in a symmetric configuration through the fins 19 and 20. The primary thrust transfer, however, is carried out into the propeller engine so that the body of this engine imparts the propulsion thrust to the vehicle during all phases.

The rocket engine thrust so transferred upon the vehicle propels the vehicle out of the container. As soon as the vehicle has left the container the wings 2 and 3 are deployed so that the propulsion is a combined engine and propeller-produced thrust. As soon as the thrust drops below a particular value but at the latest after the rocket engine fuel has been exhausted, the propeller drive 7 provides thrust which exceeds the thrust produced by the rocket engine so that the holding structure 11 releases the vehicle; i.e., the extensions 14, 15 and 16 simply recede from the concavely shaped openings in elements 17, 18, and 21 and the holding device 11 together with the rocket engine 8 just drops to the ground.

It should be noted that the connection between rocket engine and vehicle could be provided exclusively through the shroud 9; i.e., extensions 21 on the shroud could be used exclusively as thrust receiving elements connected to the several extensions 14, 15, 16 etc . . . . In this case guide elements 17 and 18 do not participate at all in that connection, and propulsion thrust is provided to the vehicle exclusively through the propeller engine, even during rocket launch.

Figure 4:
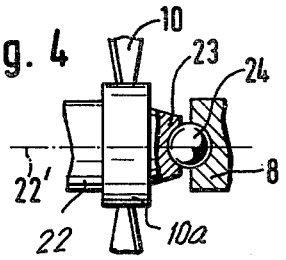
FIG. 4 is an enlargement of detail partially in section view and indicated by a dotted circle IV in FIG. 3.

The examples, to be described next, are based on the utilization of a regular propeller without a shroud. In particular, the examples shown in FIGS. 2 through 7 use regular propellers. Turning now to FIGS. 2, 3, 4, and 5, there is again shown a fuselage 4, deployable wings 2 and 3, and fins 19′ and 20′. A propeller engine 7 is mounted to the rear of the fuselage 4 for driving a propeller 10. There is, however, provided a three-fold mount for the rocket engine 8. A first mounting point is directly provided in the front end of the propeller shaft 22 rotating about an axis 22′, as shown in FIG. 4. That axis 22′ coincides with the longitudinal axis of the fuselage 4 and of the craft as a whole. The hub 10*a* of the propeller is in addition provided with a bearing element 23 constructed as a bearing mount with a concavely shaped receiving surface and indent receiving in particular a ball 24 which in turn is rotationally mounted in the rocket engine body 8. The center of that ball 24 is also situated in the shaft axis 22′. Thus, rocket engine thrust is directly imparted upon the propeller shaft.

The two additional supports for the rocket engine 8 are provided by a loop element 25 having two radial extensions and arms 26 and 27 whose front ends are of a fork like configuration to receive upper portions of the fins 19′ and 20′. The guide elements 17 and 18 are omitted in this case and instead the outer edges of the fins 19′ and 20′ are reinforced for receiving supplemental rocket engine thrust. The arms 26 and 27 of the holder 25 are, of course, strickly symmetrical to the axis 22′ and the longitudinal axis of the craft 4. Moreover, the points of interaction between the arms 26 and 27 on one hand and the fins 19′ and 20′ on the other hand are situated in a plane which traverses the axis 22′. This way it is assured that the supplemental thrust as reacted by the arms 26 and 27 into the fins 19′ and 20′, has a resultant in the axis 22′. This operation is assured if the forks at the ends of the arms 26 and 27 permit as little lateral play as possible, just sufficient so that the fins 19′ and 20′ can slide out of the fork space whenever the propeller produced thrust exceeds the rocket engine produced thrust. This way it is assured that the holding structure, particularly the holder 25, cannot laterally veer off of the desired and requisite orientation. The rocket engine 8 remains centered during the production of thrust in relation to the longitudinal axis of the craft.

Figure 5:
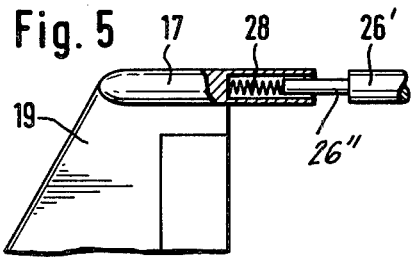
FIG. 5 is an enlarged side view of a modified portion of the vehicle and other structures shown in FIGS. 2 and 3.

FIG. 5 illustrates a modification of the connection between the arms of holder 25 on one hand and the fins 19′ and 20′ on the other hand. The figure shows in particular that the fin 19′ is provided here with a particularly configured guide and thrust receiving element 17 having a tubular opening which contains a spring 28. The arm 26′ in this case is configured to have a pin 26″ which is inserted in the opening of the guide tube 17 and bears against the spring 28. As far as the other holding arm cooperating with the fin 20′ is concerned, the construction is analogous and does not have to be duplicated as far as illustration is concerned.

The pin 26″ in this particular case insures that the holding structure 25 to which the arm 26′ pertains will not laterally escape; i.e., this pin 26″ in conjunction with the opening of the guide tube 17′ contributes to a centering of the thrust vector of the rocket engine on the axis 22′. In order to prevent binding of the pin 26″ in the opening of the tubular thrust receiving element, 17 spring 28 is normally compressed but as the thrust produced by the rocket engine is reduced the spring begins to expand and pushes the pin 26″ out of the opening, this acts as a positive assist in the separation process of the rocket engine after its thrust has dropped below the propeller thrust.

Figure 6:
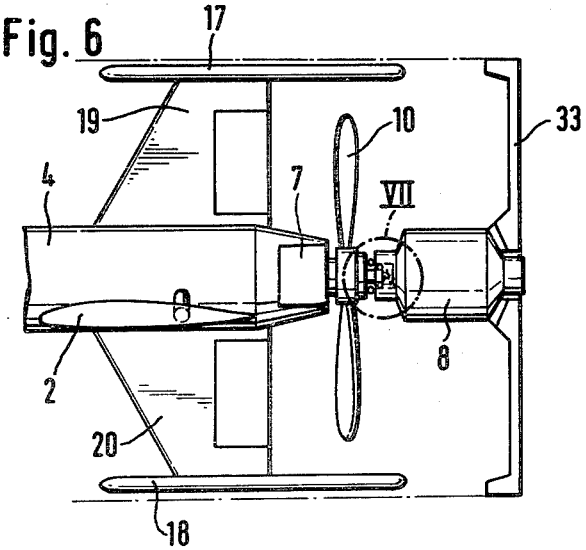
FIG. 6 is a further example of the preferred embodiment of the present invention.
Figure 7:
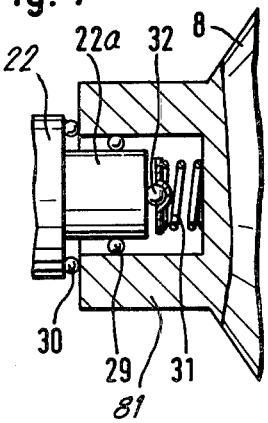
FIG. 7 is a partial section view of an enlargement, the enlarged area being indicated in FIG. 6 by a circle VII.

The example shown in FIGS. 6 and 7 is of particular interest in that the structure is chosen in that a shrouded as well as a regular propeller can be used. The drawing illustrates an unshrouded propeller drive, but a shroud could be provided for without impeding the arrangement as a whole. Also, the fins 19 and 20 in this case are usable as a rudder and are not used for purposes of support and thrust interaction. Therefore, the construction of the stabilizing fins and rudder is independent from the thrust transfer which means that their configuration and their strength does not have to be designed with a view on the thrust transfer function.

In the example shown in FIGS. 6 and 7, rocket engine 8 bears exclusively against the propeller shaft 22. The rocket engine 8 is provided with a blind bore type tubular end structure 81 configured to serve as a receiving opening for an extension 22*a* end of propeller shaft 22. This way the rocket engine is slidably mounted on the propeller shaft. In addition, there are provided two ball bearings, 29 and 30, the ball bearings 29 are radial bearings and 30 refers to an axial bearing. In lieu to these three ball bearings one may use detachable journal bearings of general construction. A spring 31 is interposed between the bottom of this extension construction 81 and a plate 32′ having an indent which receives on the other side a ball 32 which in turns bears directly against the front end face of propeller shaft extension 22*a*.

Reference numeral 33 refers to a frame which is actually a part of the container 1 and is stationarily mounted therein. It receives at center the nozzle of the rocket engine but without binding same. The frame 33 avoids axial displacement of the rocket engine 8 and any break away as well as follower rotation of the rocket engine after the propeller has been started prior to launching. As the rocket is fired, the inertia of the rocket engine impedes significantly any follower rotation aided particularly, of course, by the rotational mounting of the rocket engine on the propeller shaft. Thrust is transmitted here by means of the engine extension 81 and also directly upon the propeller shaft 22. This thrust transmission is again central as far as the axis of the body 4 and of the shaft 22 is concerned. The spring 31 has a certain centering effect but the main centering operation is carried out to the ball bearings 29. Following engine shutoff or upon dropping of the thrust of the rocket engine below the thrust produced by the propeller engine the spring 31 decompresses and separates rather rapidly the rocket engine from the propeller shaft.

The invention is not limited to the embodiments described above, but all changes and modifications thereof not constituting departues from the spirit and scope of the invention, are intended to be included.

We claim:

1. A unmanned aircraft vehicle for launching from a container, silo or the like and having wings being folded forward when the vehicle is in the container, but being deployed after launching, the vehicle having a propeller drive with a propeller that is freely-rotatable in the container, there being a launch assist rocket engine, the rocket engine and the propeller drive both capable of developing thrust, the improvement of releasably affixing the rocket engine to the vehicle comprising;

mounting and holding means on the rocket engine and being of a symmetric configuration, the holding means releasably engaging the propeller drive at least in one point, and including means (a) directly bearing on the propeller shaft and including further a means (b) for journaling the rocket engine on the propeller shaft, such that at least a portion of the rocket engine thrust is reacted into the propeller drive, and the rocket engine is disposed coaxial to a shaft of the propeller until the rocket engine thrust drops below the thrust produced by the propeller drive.

2. An unmanned aircraft vehicle as in claim 1, the mounting and holding means constructed for rendering the rocket engine axially slidably shiftable in relation to and on the propeller shaft.

3. The vehicle as in claims 1 or 2, including spring means between the vehicle and the rocket engine, the spring means being compressed upon development of thrust by the rocket engine, but effecting separation when the rocket thrust drops below the propeller thrust.

4. The vehicle as in claim 1 or 2 and including a ball bearing means for rotatively mounting the holding means on the propeller shaft.

5. The vehicle as in claim 1 the propeller drive being of the shrouded variety, the holding means including at least two points of engagement with the shroud.

6. The vehicle as in claim 5, the rocket engine including radially extending fin means carrying elements with convexly shaped front ends, the shroud being provided with thrust receiving elements having concavely shaped opening for respectively receiving said convexly shaped front ends, thereby establishing said two points.

7. An unmanned vehicle as in claim 1 or 6 the vehicle having fin means provided with guide means for guiding the vehicle in the container, the mounting and holding means additionally provided for the transfer of thrust upon the guide means on the fin means.

8. A vehicle as in claim 7, wherein the holding means are provided with convexly shaped bearing type elements and the fin means are provided with concavely shaped bearing elements being engaged by the convexly shaped elements.

9. A vehicle as in claim 7, said holding means constructed to have radially extending portions, said fin means constructed to have tubular guide elements at their outer end, said portions of said holding means carrying arms respectively inserted and slidably movable in said tubular guide elements.

10. A vehicle as in claim 9, there being compression springs in said guide elements.

11. The vehicle as in claim 1 or 6 the holding means being constructed to have radially extending means, there being axially and forwardly extending thrust transfer elements on the radially extending means, the vehicle being provided with radially extending fin means having end portions cooperating with said thrust transfer elements.

12. The vehicle as in claim 11, said thrust transfer elements being forks.

* * * * *